US008523477B2

(12) United States Patent
Lill

(10) Patent No.: US 8,523,477 B2
(45) Date of Patent: Sep. 3, 2013

(54) PRESS-FIT RESTRICTOR PLATE

(75) Inventor: Clifford Lill, Mount Pleasant, SC (US)

(73) Assignee: Campbell-Ers L.L.C., Harrison, NJ (US)

( * ) Notice: Subject to any disclaimer, the term of this patent is extended or adjusted under 35 U.S.C. 154(b) by 0 days.

(21) Appl. No.: 13/517,791

(22) Filed: Jun. 14, 2012

(65) Prior Publication Data

US 2013/0011191 A1 Jan. 10, 2013

Related U.S. Application Data

(60) Provisional application No. 61/496,959, filed on Jun. 14, 2011.

(51) Int. Cl.
*E01C 11/22* (2006.01)

(52) U.S. Cl.
USPC ..... 404/4; 404/2; 404/3; 404/5; 405/36; 405/40

(58) Field of Classification Search
USPC ..... 404/2–5, 7; 405/36, 39–43
See application file for complete search history.

(56) References Cited

U.S. PATENT DOCUMENTS

| | | | | |
|---|---|---|---|---|
| 505,130 | A * | 9/1893 | Ryan | 210/164 |
| 783,556 | A * | 2/1905 | Van Buskirk | 210/163 |
| 1,664,853 | A * | 4/1928 | Firth | 210/532.1 |
| 7,246,969 | B2 * | 7/2007 | Orser | 404/4 |
| 7,413,372 | B2 * | 8/2008 | Meyers | 404/2 |
| 7,780,372 | B2 * | 8/2010 | Fattori et al. | 404/2 |
| 8,075,220 | B1 * | 12/2011 | Suljevic | 404/4 |
| 8,419,311 | B2 * | 4/2013 | Shaw et al. | 404/2 |
| 2008/0226390 | A1 * | 9/2008 | Nino | 404/5 |
| 2011/0005045 | A1 * | 1/2011 | Lill | 24/518 |
| 2011/0278211 | A1 * | 11/2011 | Flood et al. | 210/170.03 |

* cited by examiner

*Primary Examiner* — Raymond W Addie

(57) ABSTRACT

Restrictor plates and systems for a catch basin hood are provided. The hood can include a front external surface, a front internal surface and an inlet extending therebetween. The hood inlet can defined by a plurality of surfaces, such as a top surface and a bottom surface oriented so that a height-wise cross-section of a flow channel defined by the hood inlet can be substantially trapezoidal, narrowing from an upstream side towards a downstream side. The restrictor plate can include a curbed inlet defined by a plurality of walls, including a top wall and a bottom wall oriented so that a height-wise cross-section of a curbed flow channel defined by the curbed inlet is substantially trapezoidal, whereby the top and bottom walls of the curbed inlet are disposed against respective top and bottom surfaces of the hood inlet without contacting the hood front external surface when secured thereto.

23 Claims, 10 Drawing Sheets

PRESS-FIT RESTRICTOR PLATE

CROSS-REFERENCE TO RELATED APPLICATIONS

This patent application claims the benefit of priority to U.S. Provisional Patent Application Ser. No. 61/496,959, filed Jun. 14, 2011. The foregoing patent application is incorporated by reference herein in its entirety for any purpose whatsoever.

BACKGROUND

Median style storm drain hoods are used to divert rainwater and the like to storm drainage systems. The present disclosure provides improved systems as disclosed herein.

SUMMARY OF THE DISCLOSED EMBODIMENTS

The disclosed embodiments illustrate embodiments of a restrictor plate which is capable of being positioned in an orifice of the hood inlet. The restrictor plate is capable of being inserted in (e.g., pressed into, popped into) the hood inlet and being secured thereto. In some embodiments this can be done without contacting a front external surface of the hood.

Such restrictor plates can include, for example, a front external surface, a front internal surface and an inlet extending therebetween. The hood inlet is defined by plural surfaces, including a top surface and a bottom surface oriented so that a height-wise cross-section of a flow channel defined by the hood inlet can be substantially trapezoidal, narrowing from an upstream side towards a downstream side. The restrictor plate can include a curbed inlet that is defined by plural walls, including a top wall and a bottom wall oriented so that a height-wise cross-section of a curbed flow channel defined by the curbed inlet can be substantially trapezoidal, narrowing from the upstream side towards the downstream side, whereby the top and bottom walls of the curbed inlet can be disposed against respective top and bottom surfaces of the hood inlet without contacting the hood front external surface when secured thereto.

BRIEF DESCRIPTION OF THE FIGURES

The disclosed embodiments are illustrated in the accompanying figures, which are not considered limiting, and in which.

DETAILED DESCRIPTION OF THE DISCLOSED EMBODIMENTS

Figure 1:
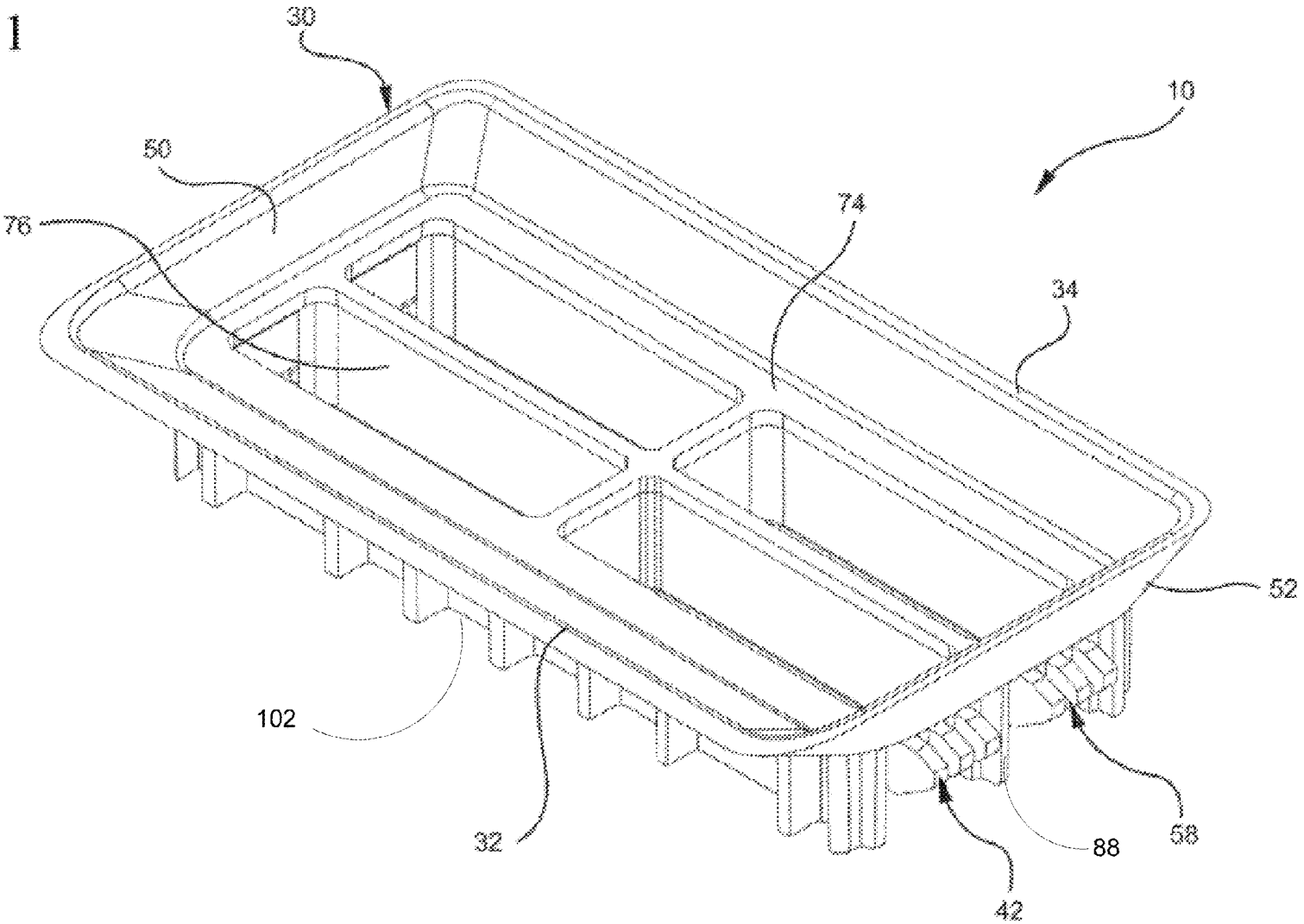
FIG. 1 is a top-perspective view of an exemplary restrictor plate in accordance with the disclosure.
Figure 2:
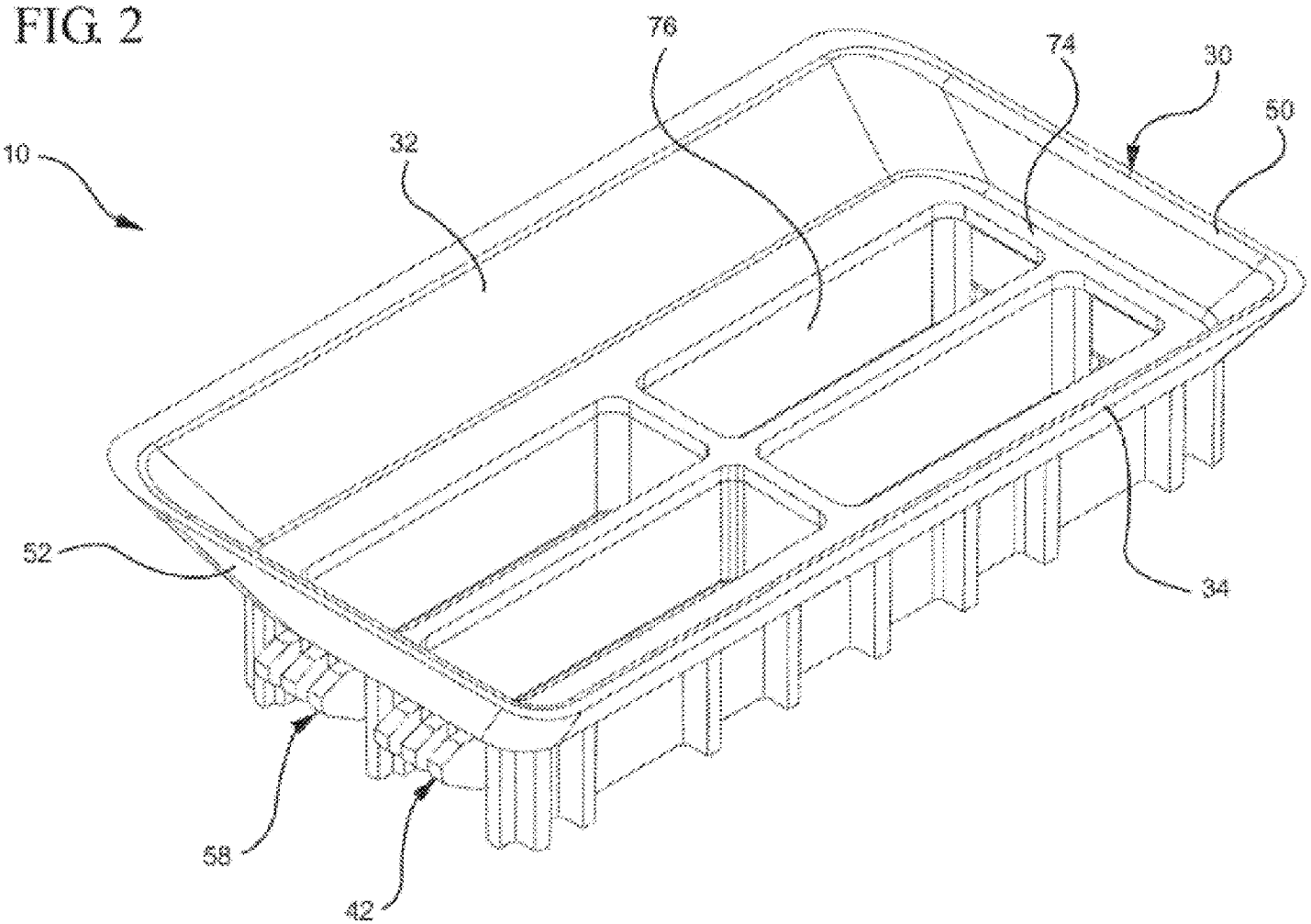
FIG. 2 is another top-perspective view of the restrictor plate of FIG. 1.
Figure 3:
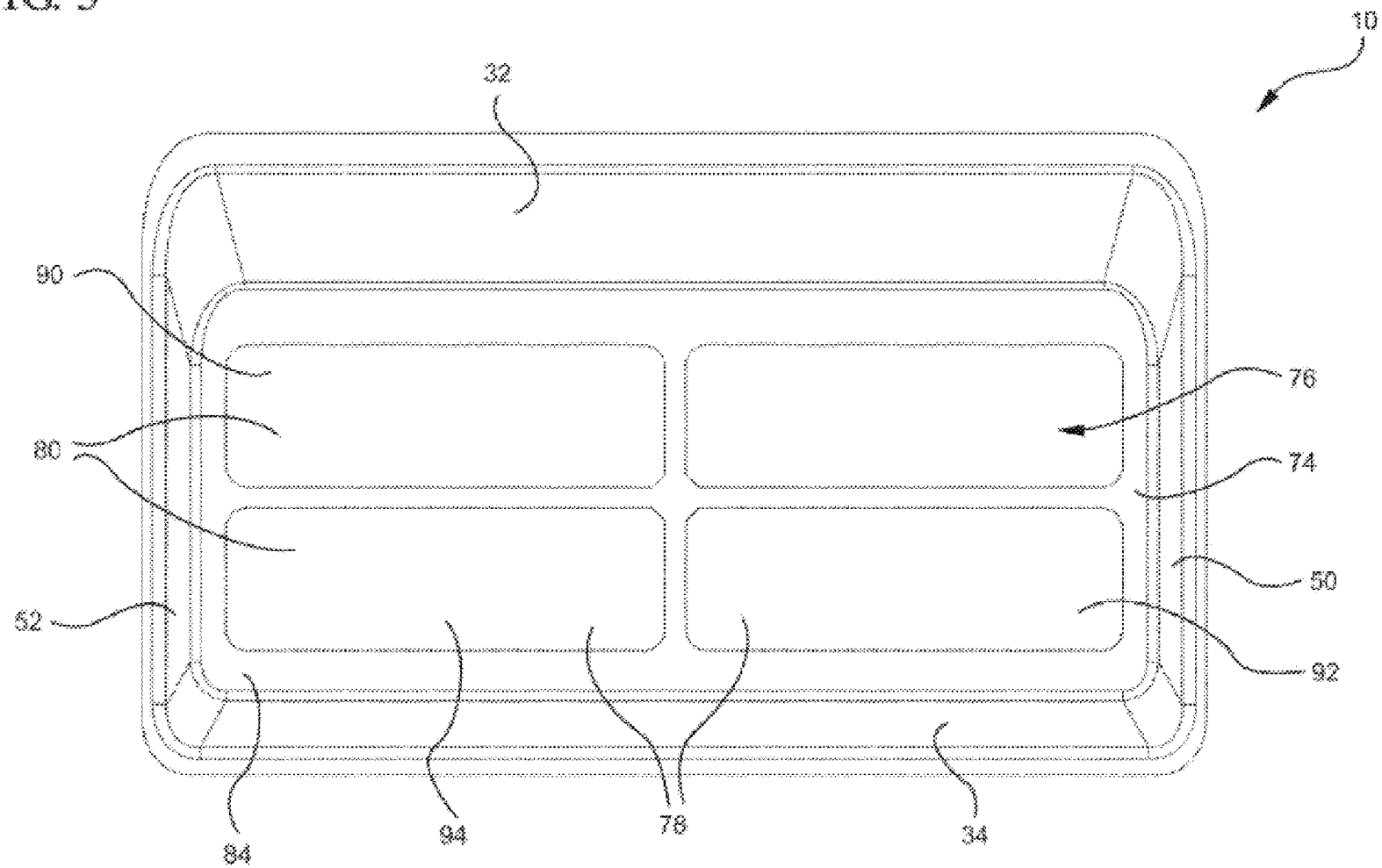
FIG. 3 is a top elevational view of the restrictor plate of FIG. 1.
Figure 4:
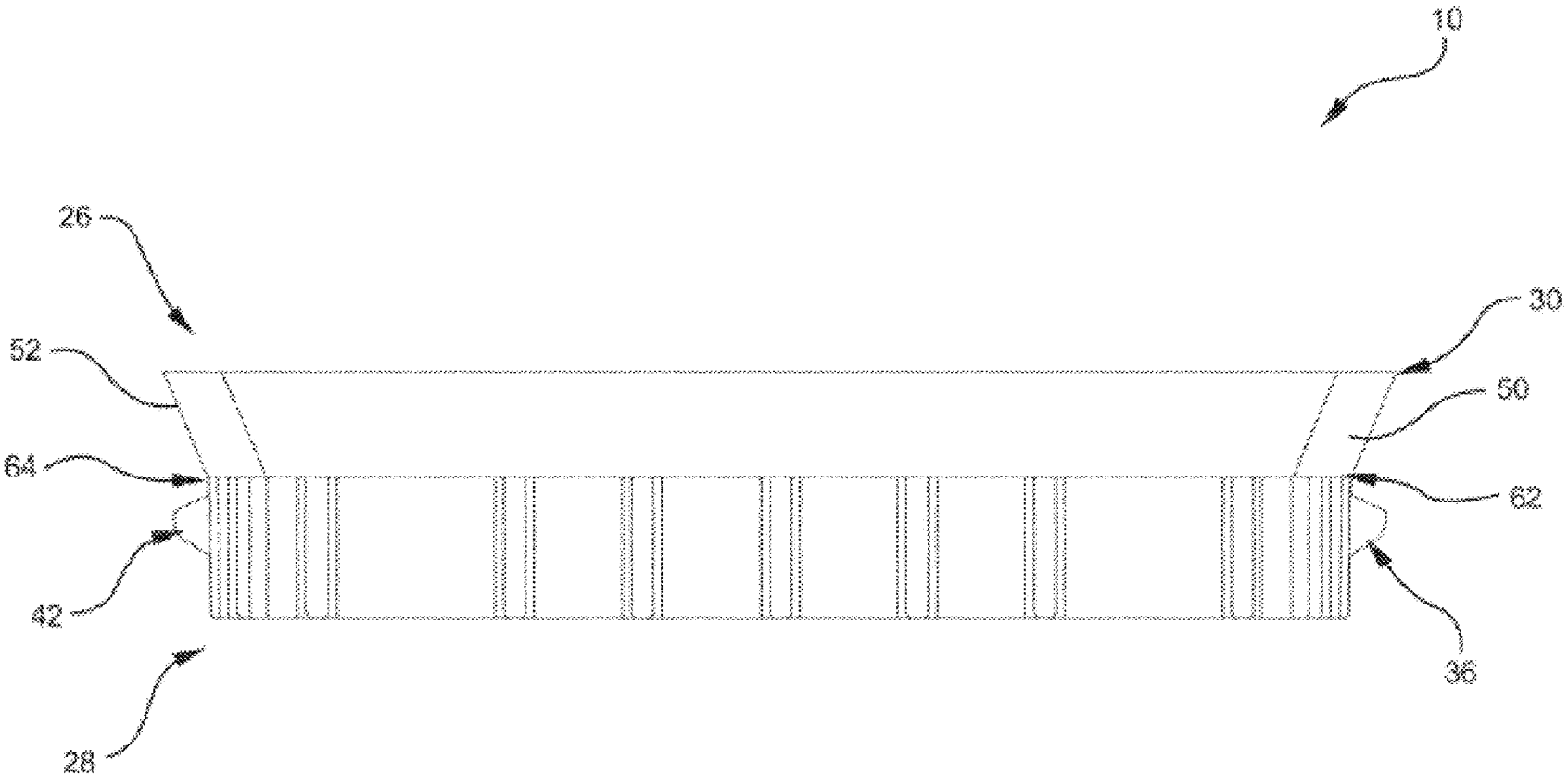
FIG. 4 is a height-wise end view of the restrictor plate of FIG. 1.
Figure 5:
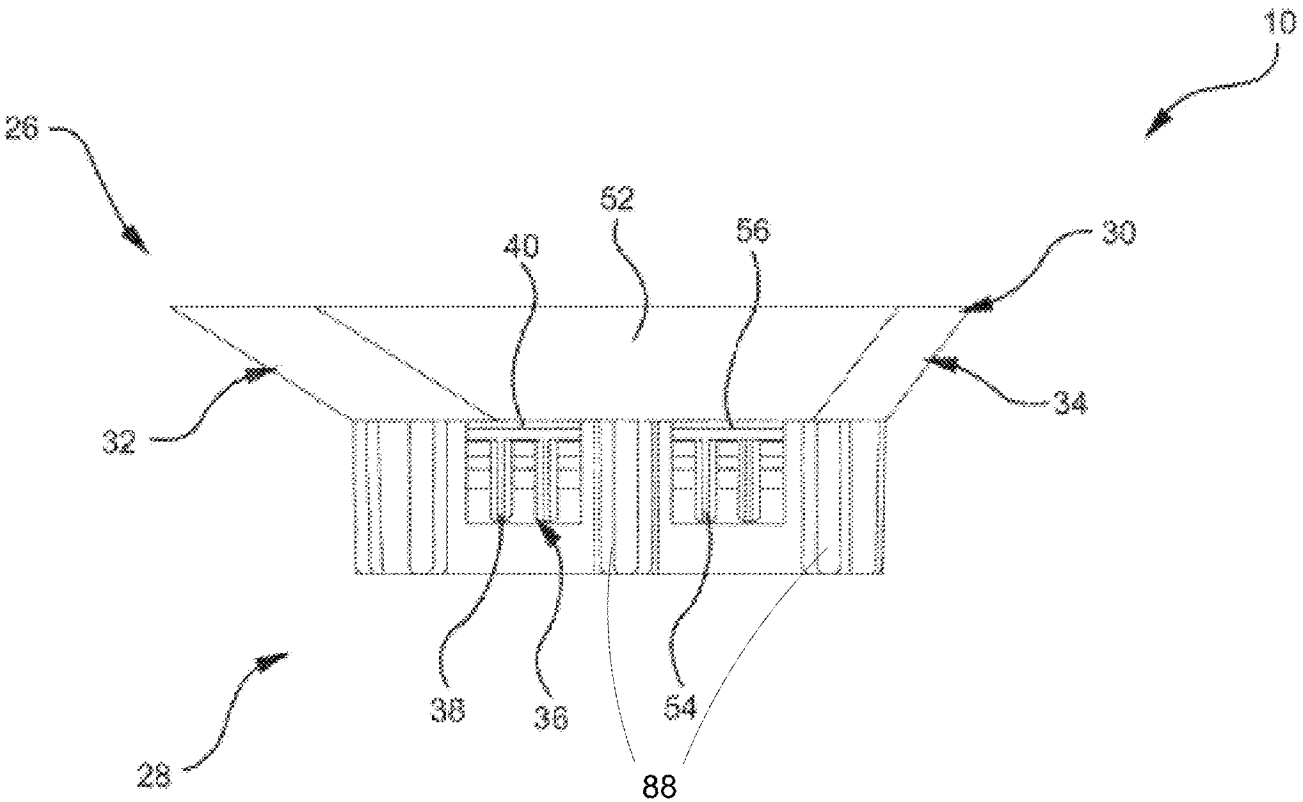
FIG. 5 is a widthwise end view of the restrictor plate of FIG. 1.

The disclosed embodiments are recited in the accompanying claims and illustrated in the accompanying figures, but are not limited by such disclosure. One embodiment, as shown in the Figures, is a restrictor plate 10 for a catch basin hood 12 (illustrated in FIG. 7-10), wherein the hood 12 includes: a front external surface 16, a front internal surface 18 and an inlet 20 extending therebetween; the hood inlet 20 defined by plural surfaces, including a top surface 22 and a bottom surface 24 oriented so that a height-wise cross-section of a flow channel defined by the hood inlet 20 is substantially trapezoidal, narrowing from an upstream side 26 towards a downstream side 28; the restrictor plate 10 including: a curbed inlet 30 defined by plural walls, including a top wall 32 and a bottom wall 34 oriented so that a height-wise cross-section of a curbed flow channel defined by the curbed inlet 30 is substantially trapezoidal, narrowing from the upstream side 26 towards the downstream side 28; whereby the top and bottom walls of the curbed inlet 30 are disposed against respective top and bottom surfaces of the hood inlet 20 without contacting the hood front external surface 16 when secured thereto. It will be appreciated that the cross section need not be trapezoidal, but can be other shapes (rectangular, curved, etc.), as desired.

Figure 6:
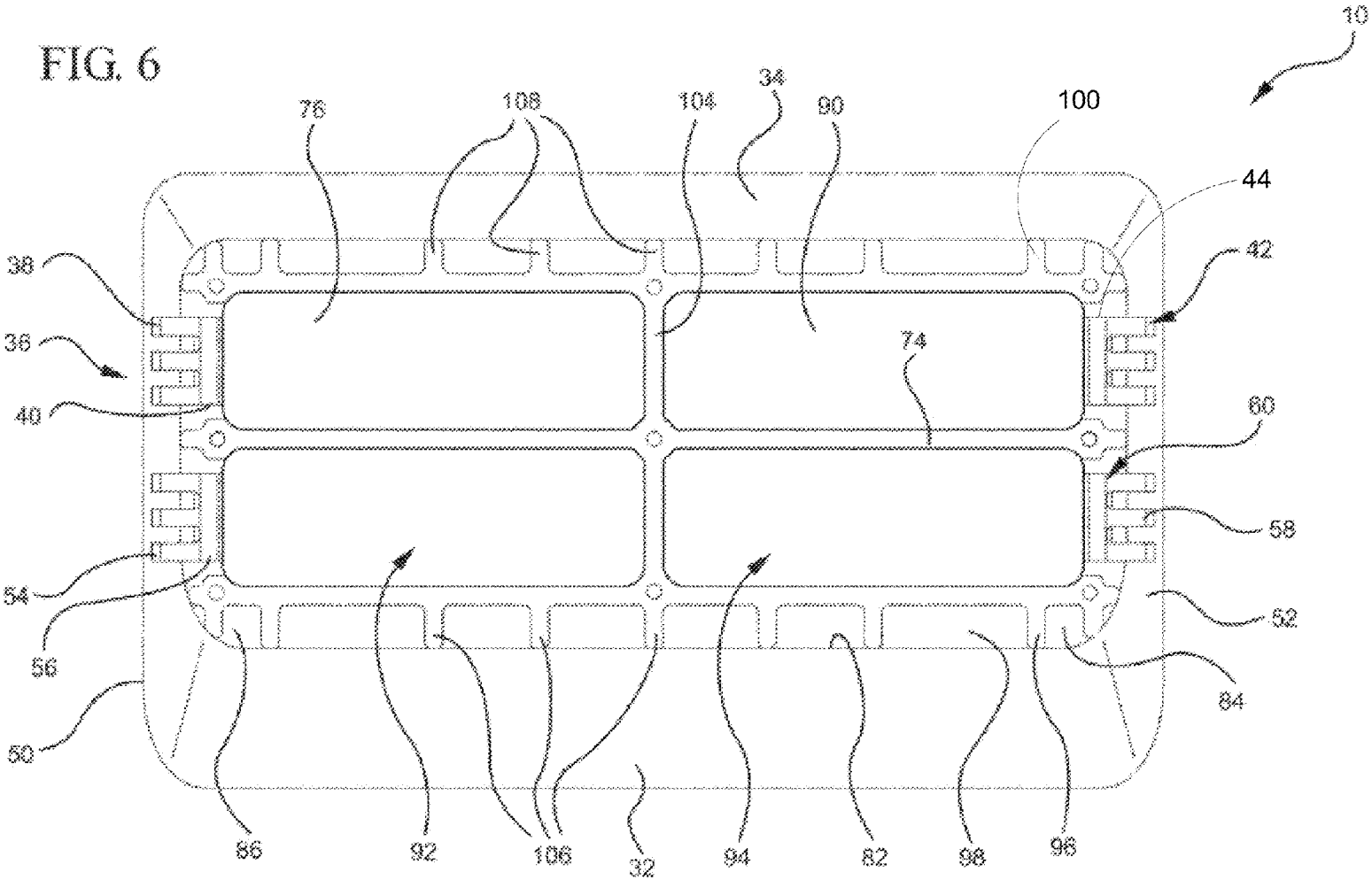
FIG. 6 is a bottom elevational view of the restrictor plate of FIG. 1.
Figure 7:
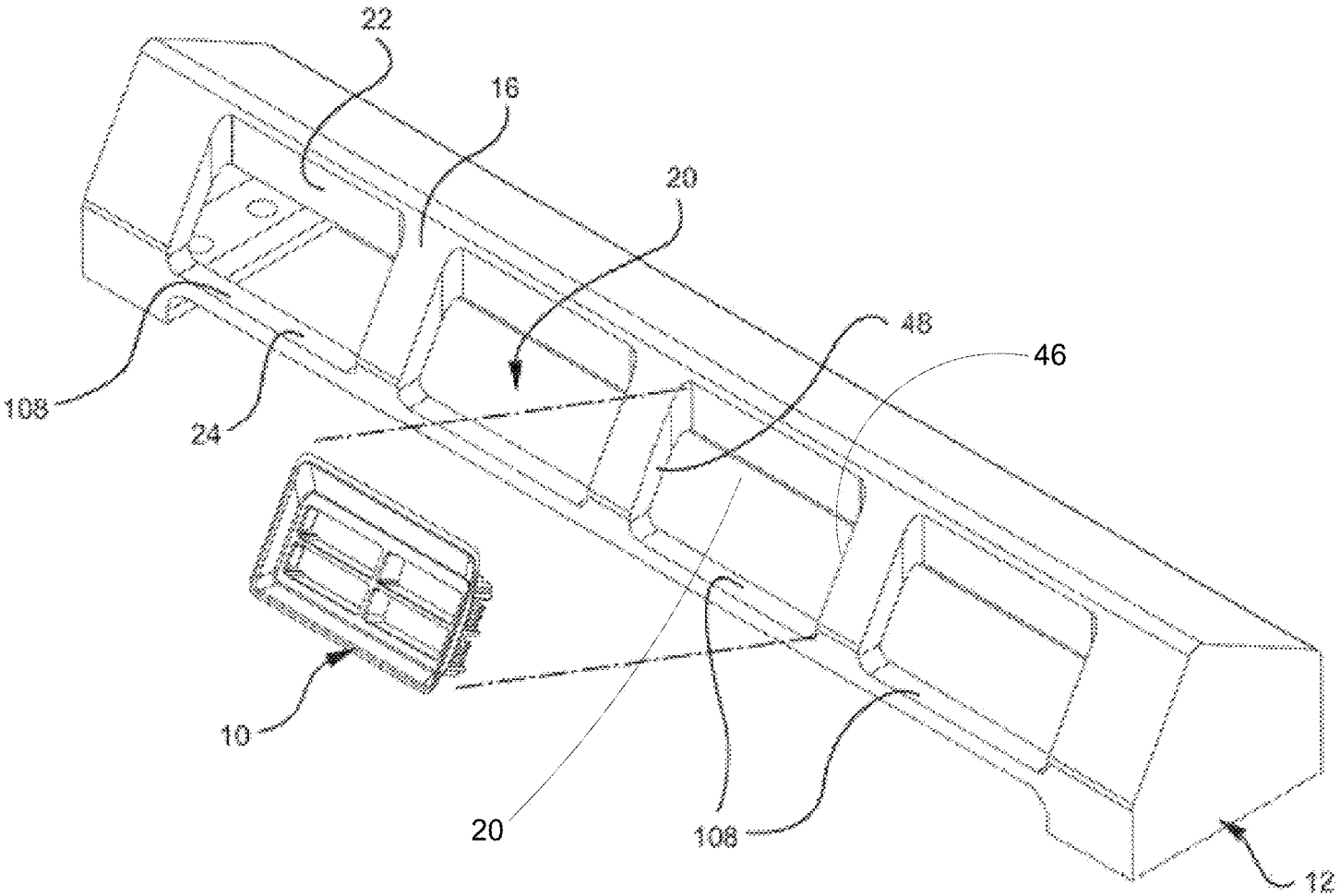
FIG. 7 is a view of the restrictor plate of FIG. 1 installed into a catch basin hood.
Figure 8:
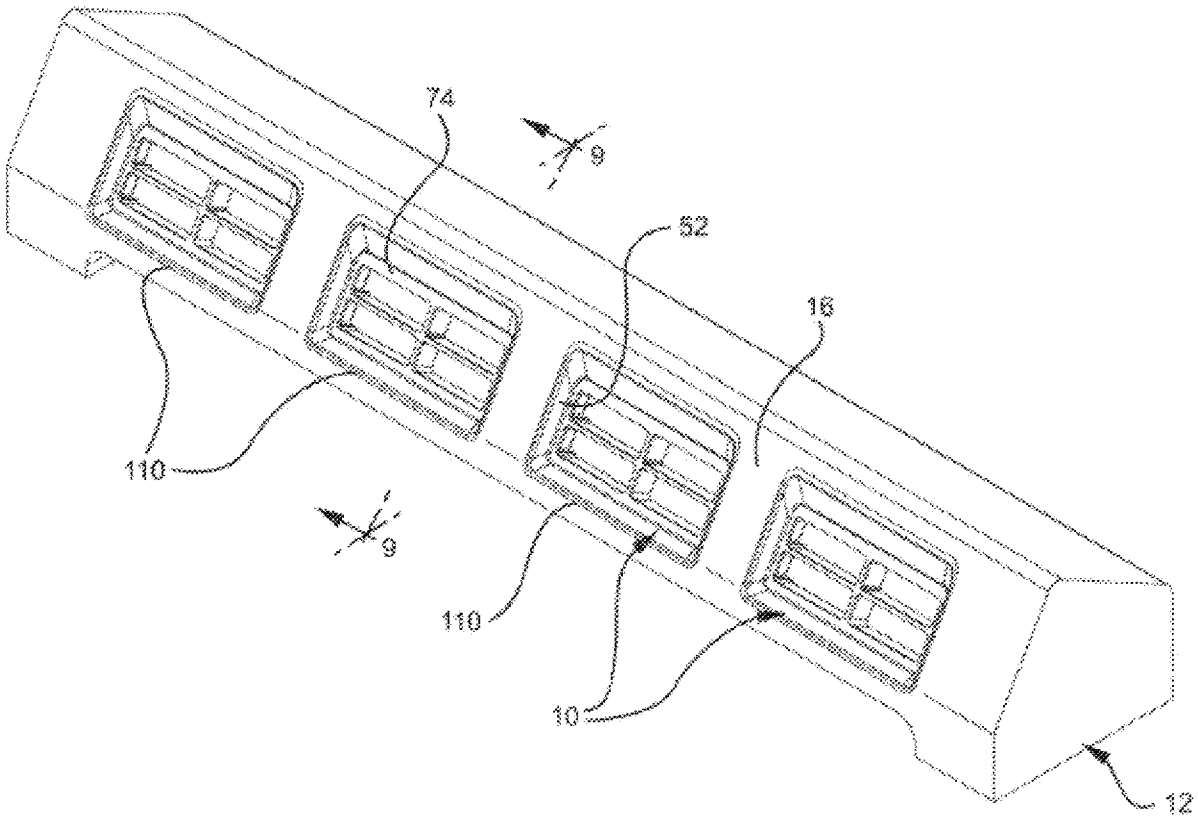
FIG. 8 is a view of the restrictor plate of FIG. 1 installed into a catch basin hood.

As shown, for example, in FIG. 6, the restrictor plate 10 may further include a securing element or retainer 36, (e.g., clip, spring latch, gripping fingers and the like). The securing element 36 projects against the basin internal surface 18 for securing thereto. As illustrated, the securing element 36 is disposed on the downstream side of the curbed inlet 30, extending from one of the plural curb inlet walls, wherein the securing element 36 projects in a transversely outward direction; the securing element 36 translates in a transversely inward direction when installing the restrictor plate 10; and the said securing element 36 translates in a transversely outward direction, against the basin internal surface 18, when installed, for securing the restrictor plate 10 to the hood inlet 20.

For purposes of illustration, and not limitation, the securing element 36 includes a securing wedge 38, which is depressed by a respective one of the plural hood inlet surfaces when installing the restrictor plate 10, thereby translating the wedge 38 in a transversely inward direction. A flexible arm 40 is also included in the securing element 36, wherein the flexible arm 40 is disposed on the downstream side of the curbed inlet 30, extends from a first one of the plural curb inlet walls, and connects the wedge 38 to the restrictor plate 10. The securing element is preferably resiliently deformable such that it can spring into its extended state after installation of the restrictor plate 10 within the hood 12.

As further illustrated, the restrictor plate 10 also includes a second securing wedge or element 42, projecting in a transversely outward direction which opposes that of the first wedge 38; and a second flexible arm 44 connecting the second wedge 42 to the downstream side of another of the plural curb inlet walls which opposes the first plural curb inlet wall. The said second wedge 42 translates in a transversely inward direction when installing the restrictor plate 10, and the said second wedge 42 translates in a transversely outward direction, against the basin internal surface 18, when installed, for securing the restrictor plate 10 to the hood inlet 20.

The plural surfaces of the hood inlet 12 include a first, proximal side surface 46 and a second, distal side surface 48 (shown in FIG. 7); the plural curb inlet walls of the restrictor plate 10 correspondingly include a proximal wall 50 and a distal wall 52 (shown in FIG. 6); in one embodiment, the first wedge 38 is connected to the proximal wall 50 via the first flexible arm 40 and the second wedge 42 is connected to the distal wall 52 via the second flexible arm 44.

Figure 9:
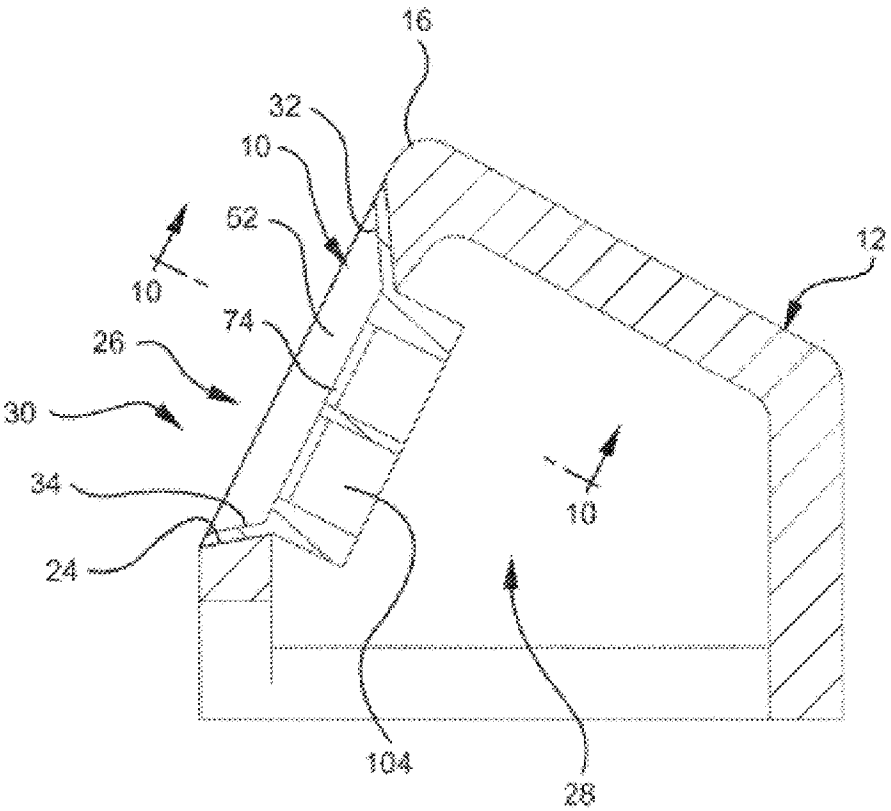
FIG. 9 is a height-wise cross sectional view of the restrictor plate of FIG. 1 installed in a catch basin hood.
Figure 10:
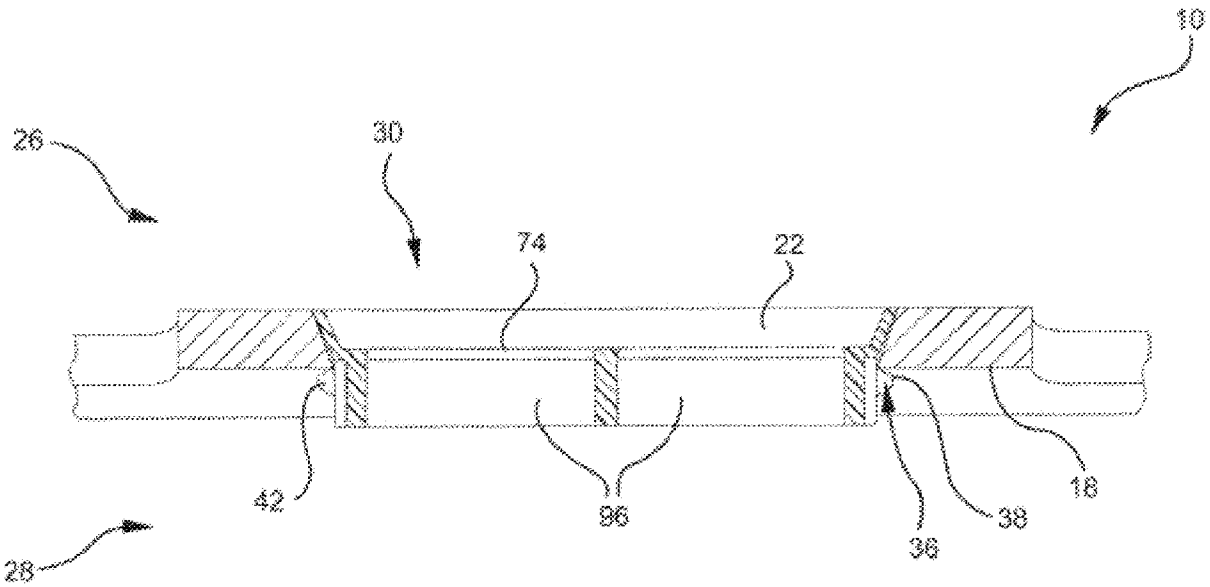
FIG. 10 is a widthwise cross sectional view of the restrictor plate of FIG. 1 installed in a catch basin hood.

The proximal side surface 46 and the distal side surface 48 of the hood inlet 20 (shown in FIG. 7) are oriented so that a widthwise cross-section of a flow channel defined by the hood inlet 20 is substantially trapezoidal, narrowing from the upstream side 26 towards the downstream side 28 (shown in FIG. 9). The proximal wall 50 and distal wall 52 of the of the restrictor plate 10 are oriented so that a height-wise cross-section of a curbed flow channel defined by the curbed inlet 30 is substantially trapezoidal, narrowing from the upstream side 26 towards the downstream side 28; whereby the proximal and distal walls 50, 52 of the curbed inlet 30 are disposed against respective proximal and distal side surfaces 46, 48 of the hood inlet 20 without contacting the hood front external surface 16 when secured thereto.

The restrictor plate 10 may further include a third securing wedge 54, connected to the proximal wall 50 by a third flexible arm 56 that extends in a downstream direction therefrom, said third wedge 54 disposed adjacent to the first wedge 38 and projecting in the same transversely outward direction as that of the first wedge 38 so as to flex therewith; and a fourth securing wedge 58, connected to the distal wall 52 by a fourth flexible arm 60 that extends in a downstream direction therefrom, said fourth wedge 58 disposed adjacent to the second wedge 42 and projecting in the same transversely outward direction as that of the second wedge 42 so as to flex therewith. The first and third wedges 38, 54 and respective flexible arms 40, 56 form a set of proximal side securing elements which may be height-wise centered on a downstream side 62 of the proximal side wall 50; and the second and fourth wedges 42, 58 and respective flexible arms 44, 60 form a set of distal side securing elements which may be height-wise centered on a downstream side 64 of the distal side wall 52.

In a preferred embodiment, the first and third wedges 38 and 54 are height-wise spaced from each other on the downstream side 62 of the proximal side wall 50; and the second and fourth wedges 42 and 58 are height-wise spaced from each other on downstream side 64 of the distal side wall 52.

The restrictor plate 10 preferably also includes a flow orifice base plate 74, at a downstream side of the curbed inlet 30, that includes at least one downstream directed flow orifice 76, sized for filtering particulates above a predetermined size from entering the hood inlet 20. The flow orifice base plate 74 may include a grid of downstream directed flow orifices, including plural rows 78 and columns 80 of flow orifices, each of which may have a substantially similar shape and size. For example, each flow orifice in the orifice base plate 74 may be substantially rectangular, having a widthwise dimension which is larger than its height-wise dimension.

In a preferred embodiment, flexible (e.g., resilient) arms 44 and 60 are connected to a downstream side 82 of the base plate 74, and at a proximal portion 84 of the base plate 74; and flexible arms 56 and 40 are connected to the downstream side 82 of the base plate 74, and at a distal portion 86 of the base plate 74. Strengthening ribs 88, extending from the downstream side 82 of the base plate 74, minimize deflection of the base plate 74 around each orifice 76. The ribs 88 extend substantially around and between each orifice 76, excluding the proximal 84 and distal 86 portions of the downstream side 82 of the base plate 74, at locations of respective flexible arms 40, 44, 56, 60.

In a preferred embodiment, as shown in FIG. 6, the grid of flow orifices includes four orifices, including the first orifice 76, a second orifice 90, a third orifice 92, and a fourth orifice 94; the first flexible arm 40 and the third flexible arm 56 respectively border the first orifice 76 and the third orifice 92, at the distal portion 84 of the downstream side 82 of the base plate 74; and the second flexible arm 44 and the fourth flexible arm 60 respectively border the second orifice 90 and the fourth orifice 94, at the proximal portion 86 of the downstream side 82 of the base plate 74.

The strengthening ribs 88 may include a widthwise extending top rib 96, disposed at the downstream side 82 of the base plate 74, at a top portion 98 of the base plate 74, and substantially continuous between the proximal wall 50 and the distal wall 52; a widthwise extending bottom rib 100, disposed at the downstream side 82 of the base plate 74, at a bottom portion 102 of the base plate 74, is substantially continuous between the proximal wall 50 and the distal wall 52; and a height-wise extending intermediate rib 104, disposed at the downstream side 82 of the base plate 74, preferably at a widthwise center portion thereof, and substantially continuous between the top wall 32 and the bottom wall 34.

The top rib 96 may include a set of alignment ribs 106 extending in a transversely outward direction therefrom, and the bottom rib 100 may include a set of alignment ribs 108 extending in a transversely outward direction therefrom, wherein the alignment ribs 106, 108 align the restrictor plate 10 in the hood inlet 20 when installing the restrictor plate 10 therein.

The restrictor plate 10 may be molded as a unitary structure from plastic, steel and/or a composite. If desired, the retainers/clips/securing elements (e.g., 36) can be made from a different material from the remainder of the plate 10. For example, the securing elements can be made from a first material that is more resilient (e.g., spring like) than the rest of the plate 10. In one embodiment, the plate 10 may be insert molded over the clips from a polymer/composite material, which in turn may be made from a stiffer polymer and/or metallic material.

In another embodiment of the present invention, a storm drain assembly includes a catch basin hood 12, which may be cast from steel, which includes a front external surface 16, a front internal surface 18 and at least one inlet 20 extending therebetween; the hood inlet 20 is defined by plural surfaces, including a top surface 22 and a bottom surface 24 oriented so that a height-wise cross-section of a flow channel defined by the hood inlet 20 is substantially trapezoidal (or other shape), narrowing from an upstream side 26 towards a downstream side 28. The assembly further comprises at least one restrictor plate 10 capable of being installed in the at least one hood inlet 20. In a preferred embodiment, plural hood inlets 108 are aligned in a row and plural restrictor plates 110 are respectively installed in the plural inlets 108.

I claim:

1. A restrictor plate system for a catch basin hood, comprising:

a hood including:

a front external surface, a front internal surface and an inlet extending therebetween; and a hood inlet defined by a plurality of adjoining surfaces, the surfaces including a top surface and a bottom surface oriented such that a height-wise cross-section of a flow channel defined by the hood inlet is substantially trapezoidal, and narrows from an upstream side towards a downstream side; and a restrictor plate including:

a curbed inlet defined by a plurality of walls, the walls including a top wall and a bottom wall mutually arranged such that a curbed flow channel defined by a height-wise cross-section of the curbed inlet is substantially trapezoidal, narrowing from the upstream side towards the downstream side;

wherein the top and bottom walls of the curbed inlet are disposed against respective top and bottom surfaces of the hood inlet when installed.

2. The restrictor plate system of claim 1, wherein the restrictor plate doe not contact the front external surface of the hood when the restrictor plate is installed in the hood.

3. The restrictor plate system of claim 1, wherein the restrictor plate includes a retainer that projects against the basin internal surface for securing the restrictor plate to the hood.

4. The restrictor plate system of claim 3, wherein:

the retainer is disposed on a downstream side of the curbed inlet, extending from one of the plural curb inlet walls, wherein the retainer projects in a transversely outward direction;

the retainer translates in a transversely inward direction when installing the restrictor plate; and the retainer translates in a transversely outward direction, against the basin internal surface, when installed in the hood, for securing the restrictor plate to the hood inlet.

5. The restrictor plate system of claim 4, wherein:

the retainer includes a securing wedge, which is depressed by a respective one of the plural hood inlet surfaces when installing the restrictor plate, thereby translating the wedge in a transversely inward direction.

6. The restrictor plate system of claim 5, wherein:

the retainer includes a flexible arm, and wherein:

the flexile arm is disposed on the downstream side of the curbed inlet, extends from one of the plural curb inlet walls, and connects the wedge to the restrictor plate.

7. The restrictor plate system of claim 6, wherein:

the wedge is a first wedge and said flexible arm is a first flexible arm connecting the first wedge to the downstream side of a first one of the plural curb inlet walls; and the restrictor plate includes:

a second securing wedge, projecting in a transversely outward direction which opposes that of the first wedge; and a second flexible arm connecting the second wedge to the downstream side of another of the plural curb inlet walls which opposes the first one of the plural curb inlet walls;

said second wedge translates in a transversely inward direction when installing the restrictor plate; and said second wedge translates in a transverse outward direction, against the basin internal surface, when installed for securing the restrictor plate to the hood inlet.

8. The restrictor plate system of claim 6, wherein:

the plural surfaces of the hood inlet include a proximal side surface and a distal side surface;

the plural curb inlet walls further include a proximal wall and a distal wall;

the first wedge is connected to the proximal wall via the first flexible arm and the second wedge is connected to the distal wall via the second flexible arm.

9. The restrictor plate system of claim 7, where the restrictor plate further includes:

a third securing wedge, connected to the proximal wall by a third flexible arm that extends in a downstream direction therefrom, said third wedge disposed adjacent to the first wedge and projecting in the same transversely outward direction as that of the first wedge so as to flex therewith; and a fourth securing wedge, connected to the distal wall by a fourth flexible arm that extends in a downstream direction therefrom, said fourth wedge disposed adjacent to the second wedge and projecting in the same transversely outward direction as that of the second wedge so as to flex therewith.

10. The restrictor plate system of claim 8, wherein:

the first and third wedges and respective flexible arms form a set of proximal side retainers which are height-wise centered on a downstream side of the proximal side wall; and the second and fourth wedges and respective flexible arms form a set of distal side retainers which are height-wise centered on a downstream side of the distal side wall.

11. The restrictor plate system of claim 9, wherein:

the first and third wedges are height-wise spaced from each other on the downstream side of the proximal side wall; and the second and fourth wedges are height-wise spaced from each other on downstream side of the distal side wall.

12. The restrictor plate system of claim 7, wherein:

the proximal side surface and the distal side surface of the hood inlet are oriented so that a widthwise cross-section of a flow channel defined by the hood inlet is substantially trapezoidal, narrowing from the upstream side towards the downstream side; and the proximal wall and distal wall of the of the restrictor plate are oriented so that a height-wise cross-section of a curbed flow channel defined by the curbed inlet is substantially trapezoidal, narrowing from the upstream side towards the downstream side;

whereby the proximal and distal walls of the curbed inlet are disposed against respective proximal and distal side surfaces of the hood inlet without contacting the hood front external surface when secured thereto.

13. The restrictor plate system of claim 10, wherein:

the restrictor plate includes a flow orifice base plate, at a downstream side of the curbed inlet, that includes at least one downstream directed flow orifice, sized for filtering particulates above a predetermined size from entering the hood inlet.

14. The restrictor plate system of claim 12, wherein:

the flow orifice base plate includes a grid of downstream directed flow orifices, including plural rows and columns of flow orifices, each having a substantially same shape and size.

15. The restrictor plate system of claim 13, wherein:

each flow orifice in the orifice base plate is substantially rectangular, having a widthwise dimension which is larger than a height-wise dimension.

16. The restrictor plate system of claim 14, wherein:

the first and third flexible arms are connected to a downstream side of the base plate, and at a proximal portion of the base plate; and the second and fourth flexible arms are connected to the downstream side of the base plate, and at a distal portion of the base plate.

17. The restrictor plate system of claim 15, further comprising:

strengthening ribs, extending from the downstream side of the base plate, which minimize deflection of the base plate around each orifice.

18. The restrictor plate system of claim 16, wherein:

the strengthening ribs extend substantially around and between each orifice, excluding the proximal and distal portions of the downstream side of the base plate, at locations of respective flexible arms.

19. The restrictor plate system of claim 17, wherein:

the orifice is a first orifice, and the grid of flow orifices includes four orifices, including the first orifice, a second orifice, a third orifice, and a fourth orifice;

the first flexible arm and the third flexible arm respectively border the first orifice and the third orifice, at the proximal portion of the downstream side of the base plate; and the second flexible arm and the fourth flexible arm respectively border the second orifice and the fourth orifice, at the distal portion of the downstream side of the base plate.

20. The restrictor plate system of claim 18, wherein the strengthening ribs include:

a widthwise extending top rib, disposed at the downstream side of the base plate, at a top portion of the base plate, and substantially continuous between the proximal wall and the distal wall;

a widthwise extending bottom rib, disposed at the downstream side of the base plate, at a bottom portion of the base plate, and substantially continuous between the proximal wall and the distal wall; and a height-wise extending intermediate rib, disposed at the downstream side of the base plate, at a widthwise center portion thereof, and substantially continuous between the top wall and the bottom wall.

21. The restrictor plate system of claim 19, wherein:

the top rib includes a set of alignment ribs extending in a transversely outward direction therefrom; and the bottom rib includes a set of alignment ribs extending in a transversely outward direction therefrom;

wherein the alignment ribs align the restrictor plate in the hood inlet when installing the restrictor plate therein.

22. The restrictor plate system of claim 20, molded as a unitary structure.

23. The restrictor plate system of claim 21, molded from plastic, steel and/or a composite.

* * * * *